US009291944B2

(12) United States Patent
Shimizu et al.

(10) Patent No.: US 9,291,944 B2
(45) Date of Patent: Mar. 22, 2016

(54) DEVELOPING DEVICE HAVING A CONTROL DEVICE THAT PERFORMS A RECOVERY PROCESS AND IMAGE FORMING APPARATUS INCLUDING THE SAME

(71) Applicant: KYOCERA Document Solutions Inc., Osaka (JP)

(72) Inventors: Tamotsu Shimizu, Osaka (JP); Akira Matayoshi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/632,225

(22) Filed: Feb. 26, 2015

(65) Prior Publication Data

US 2015/0253693 A1 Sep. 10, 2015

(30) Foreign Application Priority Data

Mar. 4, 2014 (JP) ..... 2014-041842

(51) Int. Cl.
*G03G 15/08* (2006.01)
*G03G 21/10* (2006.01)

(52) U.S. Cl.
CPC ..... *G03G 15/0889* (2013.01); *G03G 15/0858* (2013.01); *G03G 15/0893* (2013.01); *G03G 21/105* (2013.01)

(58) Field of Classification Search
CPC ..... G03G 15/08–15/0898; G03G 21/10; G03G 21/105
See application file for complete search history.

(56) References Cited

U.S. PATENT DOCUMENTS 5,355,199 A * 10/1994 Bray ..... 399/256
2008/0310865 A1* 12/2008 Uno et al. ..... 399/30

FOREIGN PATENT DOCUMENTS

JP 2010-217501 9/2010

* cited by examiner

*Primary Examiner* — Clayton E Laballe
*Assistant Examiner* — Ruifeng Pu
(74) *Attorney, Agent, or Firm* — Wenderoth, Lind & Ponack, L.L.P.

(57) ABSTRACT

A developing device includes a housing, a stirring member, a developing unit body, a driving device, a detecting device, and a control device. The housing accommodates developer supplied from a supply means and including toner and carrier. The stirring member rotates in the housing to stir the developer. The developing unit body rotates in the housing to convey the developer toward an image carrying member from the stirring member and attaches the toner to the image carrying member. The driving device rotationally drive at least one of the stirring member and the developing unit body. The detecting device detects the torque of the driving device. The control device performs a recovery process of controlling the supply means to supply at least one of the carrier and the developer to an interior of the housing when a detection result of the detecting device has a value lower than a threshold value.

11 Claims, 10 Drawing Sheets

Fig.7

| | | Reversal development (OPC) | Reversal development (α-Si) | Normal development (OPC) |
|---|---|---|---|---|
| Photosensitive drum | | | | |
| Non-exposure portion potential (Vo) | [V] | +430 | +230 | -460 |
| Exposure portion potential (VL) | [V] | +100 | +20 | -100 |
| Developing roller | | | | |
| DC voltage (V10) | [V] | +490 | +280 | -60 |
| AC voltage (V11) | [V] | 650 | 1150 | 650 |
| Recovery voltage (V12) | [V] | +455 | +260 | -110 |
| Frequency of AC voltage | [kHz] | 3.7 | 3.85 | 3.7 |
| Duty of AC voltage | [%] | 73 | 63 | 73 |
| Developing roller | | | | |
| DC voltage (V20) | [V] | +190 | +50 | -360 |
| AC voltage (V21) | [V] | 1500 | 1500 | 1500 |
| Recovery voltage (V22) | [V] | +155 | +30 | -410 |
| Frequency of AC voltage | [kHz] | 3.7 | 3.85 | 3.7 |
| Duty of AC voltage | [%] | 27 | 37 | 27 |
| Reference potential difference△ V0 (ordinary) | | | | |
| DC voltage (V20) - exposure portion potential (VL) | [V] | 90 | 30 | |
| DC voltage (V20) - Non-exposure portion potential (Vo) | [V] | | | 100 |
| Reference potential difference△ V1 (Recovery process) | | | | |
| Recovery voltage (V22) - exposure portion potential (VL) | [V] | 55 | 10 | |
| Recovery voltage (V22) - Non-exposure portion potential (Vo) | [V] | | | 50 |

Fig.8

Initial value ⇩ Threshold value TH ⇩

| Torque (T) [mNm] | 31.0 | 29.5 | 27.9 | 26.4 | 24.8 | 24.2 | 23.3 |
|---|---|---|---|---|---|---|---|
| Torque ratio [%] | 100 | 95 | 90 | 85 | 80 | 78 | 75 |
| Developer amount (Q) [g] | 230 | 210 | 180 | 165 | 145 | 135 | 130 |
| Presence or absence of image defect | Absence | Absence | Absence | Absence | Absence | Presence | Presence |

DEVELOPING DEVICE HAVING A CONTROL DEVICE THAT PERFORMS A RECOVERY PROCESS AND IMAGE FORMING APPARATUS INCLUDING THE SAME

CROSS-REFERENCE TO RELATED APPLICATION

This application is based upon and claims the benefit of priority from Japanese Patent Application No. 2014-041842 filed on Mar. 4, 2014, the entire contents of which are incorporated herein by reference.

BACKGROUND

The technology of present disclosure relates to a developing device that supplies developer to an image carrying member and an image forming apparatus including the same.

Conventionally, a developing device using a two-component developer including toner and carrier is configured to perform a development process by consuming only the toner. The toner is supplied in response to a reduction amount due to consumption and the carrier is repeatedly used. The developing device is configured to discharge developer including carrier deteriorated due to repeated use, and receive the supply of developer including new carrier (a so-called trickle development system).

As such a type of developing device, there has been proposed a device including a developer container (hereinafter, referred to as a "container") that accommodates developer (two-component developer), a developing roller and the like that carry the developer in the container and attach toner to a photosensitive drum, a supply port that supplies developer to an interior of the container, and a discharge port that discharges the developer from the interior of the container. The developing device includes an inclination detection means that detects an inclination of the container and a control means that controls an opening/closing means that opens and closes the discharge port on the basis of a detection result of the inclination detection means. When the discharge port has been inclined downward, the developing device closes the opening/closing means to suppress a discharge amount of the developer.

SUMMARY

In order to attain the object described above, a developing device according to one aspect of the present disclosure includes a housing, a stirring member, a developing unit body, a driving device, a detecting device, and a control device. The housing accommodates developer supplied from a supply means and including toner and carrier therein. The stirring member rotates in the housing to stir the developer in the housing. The developing unit body rotates in the housing to convey the developer in the housing toward an image carrying member from the stirring member and attaches the toner included in the developer to the image carrying member. The driving device rotationally drive at least one of the stirring member and the developing unit body. The detecting device detects the torque of the driving device. The control device performs a recovery process of controlling the supply means to supply at least one of the carrier and the developer to an interior of the housing when a detection result of the detecting device has a value lower than a threshold value.

A developing device according to another aspect of the present disclosure includes a housing, a stirring member, a developing unit body, a driving device, a detecting device, and a control device. The housing accommodates developer supplied from a supply means and including toner and carrier therein. The stirring member rotates in the housing to stir the developer in the housing. The developing unit body rotates in the housing to convey the developer in the housing toward an image carrying member from the stirring member and attaches the toner included in the developer to the image carrying member. The driving device rotationally drive at least one of the stirring member and the developing unit body. The detecting device detects the torque of the driving device. The control device performs a recovery process of controlling the developing unit body to consume the toner and controlling the supply means to supply the developer to an interior of the housing when a detection result of the detecting device has a value lower than a threshold value.

BRIEF DESCRIPTION OF THE DRAWINGS

FIG. 7 is a table illustrating voltages and potential differences of each element in an experiment using a developing device according to a first embodiment.

FIG. 8 is a table illustrating an experiment result using a developing device according to a first embodiment.

DETAILED DESCRIPTION

Hereinafter, the present embodiment will be described with reference to the accompanying drawings. In addition, in the following description, for the purpose of convenience, each direction is defined as indicated by arrows in each drawing.

First Embodiment

Figure 1:
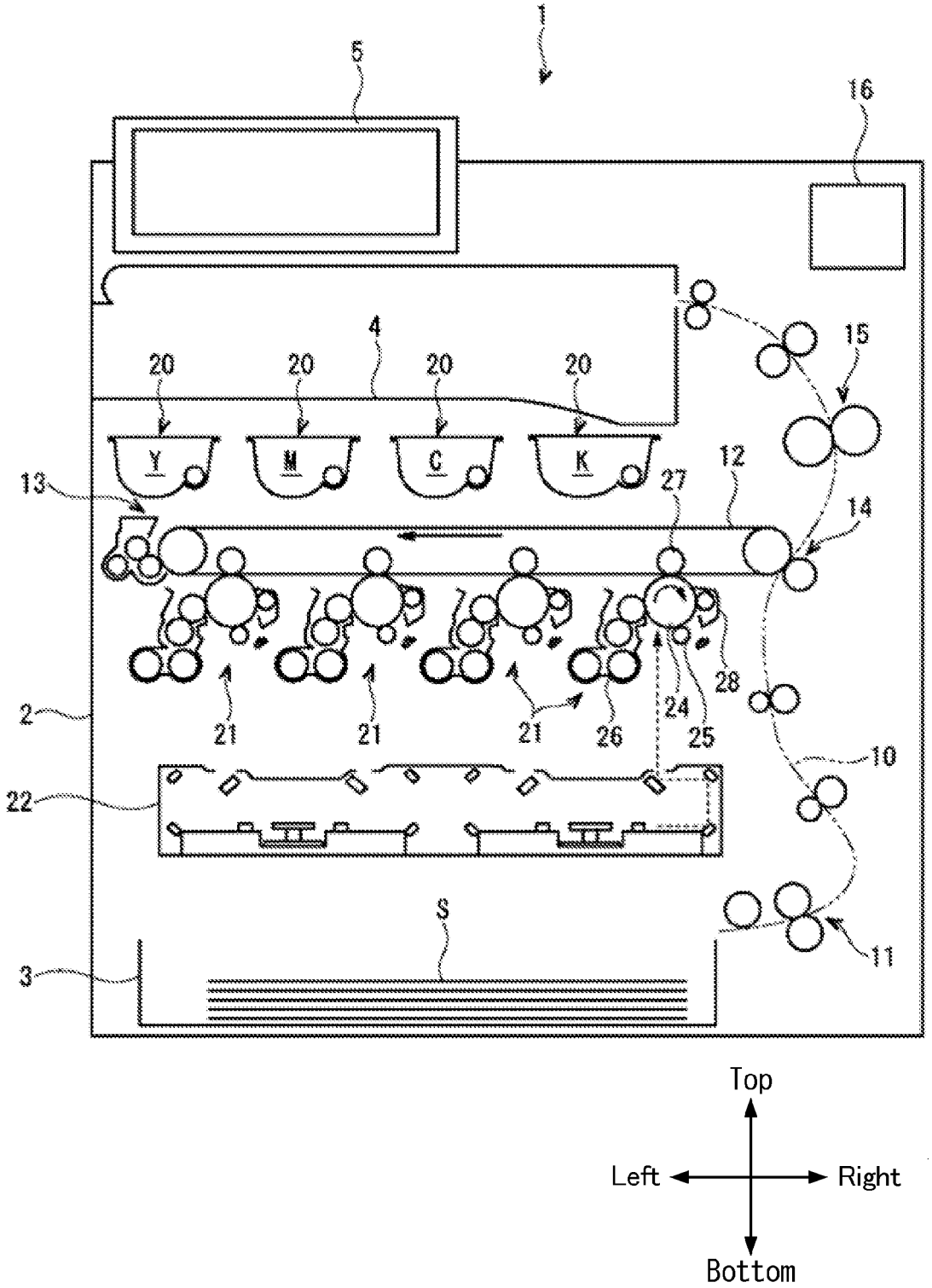
FIG. 1 is a sectional view schematically illustrating an internal structure of a color printer according to a first embodiment.

With reference to FIG. 1, an entire configuration of a color printer 1 as an image forming apparatus will be described.

FIG. 1 is a sectional view schematically illustrating an internal structure of the color printer 1.

The color printer 1 includes an approximately box-shaped apparatus body 2, a sheet feeding cassette 3 provided below the apparatus body 2, and a sheet discharge tray 4 provided above the apparatus body 2. The apparatus body 2 is provided at an upper portion thereof with a liquid crystal display 5 serving as a presentation device that presents (displays) various types of information to a user. In addition, sheets S accommodated in the sheet feeding cassette 3 are not limited to papers, and may include resin films, OHP sheets and the like.

The apparatus body 2 of the color printer 1 includes a sheet feeding section 11 that supplies the sheets S in the sheet feeding cassette 3 to a conveyance path 10, an image forming unit 13 that primarily transfers a toner image to an intermediate transfer belt 12, a secondary transfer nip portion 14 that secondarily transfers the primarily transferred toner image to the sheets S, a fixing device 15 that fixes the secondarily transferred toner image to the sheets S, and a main control device 16 that performs overall control of each device.

The image forming unit 13 is configured to perform image formation by using four colors (Y, M, C, and K) of developers for supply accommodated in four toner containers 20. The image forming unit 13 includes four drum units 21 and an exposure unit 22 that irradiates laser light to the surface of each photosensitive drum 24. In addition, developer accommodated in the toner containers 20 serving as a supply means is a so-called two-component developer including toner and carrier.

The four drum units 21 are arranged at a lower side of the intermediate transfer belt 12 in parallel with one another in a front and rear direction. Each drum unit 21 includes the photosensitive drum 24 rotatably supported and serving as an image carrying member, and a charging device 25, a developing device 26, a primary transfer roller 27, and a cleaning device 28 which are sequentially disposed around the photosensitive drum 24 in sequence of a transfer process.

Here, an operation of the color printer 1 will be described. When the color printer 1 is powered on, the main control device 16 performs initialization and the like of various types of parameters. Image data is inputted from a personal computer and the like connected to the color printer 1, and when a print start instruction is issued, the main control device 16 performs an image forming operation as follows.

The exposure unit 22 performs exposure (see a broken line arrow of FIG. 1) corresponding to image data to form an electrostatic latent image on the surface of the photosensitive drum 24 charged with a predetermined potential by the charging device 25. Each developing device 26 develops the electrostatic latent image into a toner image by toner supplied from the toner container 20. The intermediate transfer belt 12 sequentially carries primarily transferred toner images of each color by each primary transfer roller 27 to which a primary transfer bias has been applied.

On the other hand, the sheet S supplied from the sheet feeding cassette 3 is conveyed through the conveyance path 10 and passes through the secondary transfer nip portion 14. The secondary transfer nip portion 14 transfers a full color toner image to the sheet S by an applied secondary transfer bias. The fixing device 15 fixes the toner image to the sheet S. The sheet S subjected to the fixing process is discharged to the sheet discharge tray 4. The cleaning device 28 removes toner remaining on the surface of the photosensitive drum 24 after the transfer.

Figure 2:
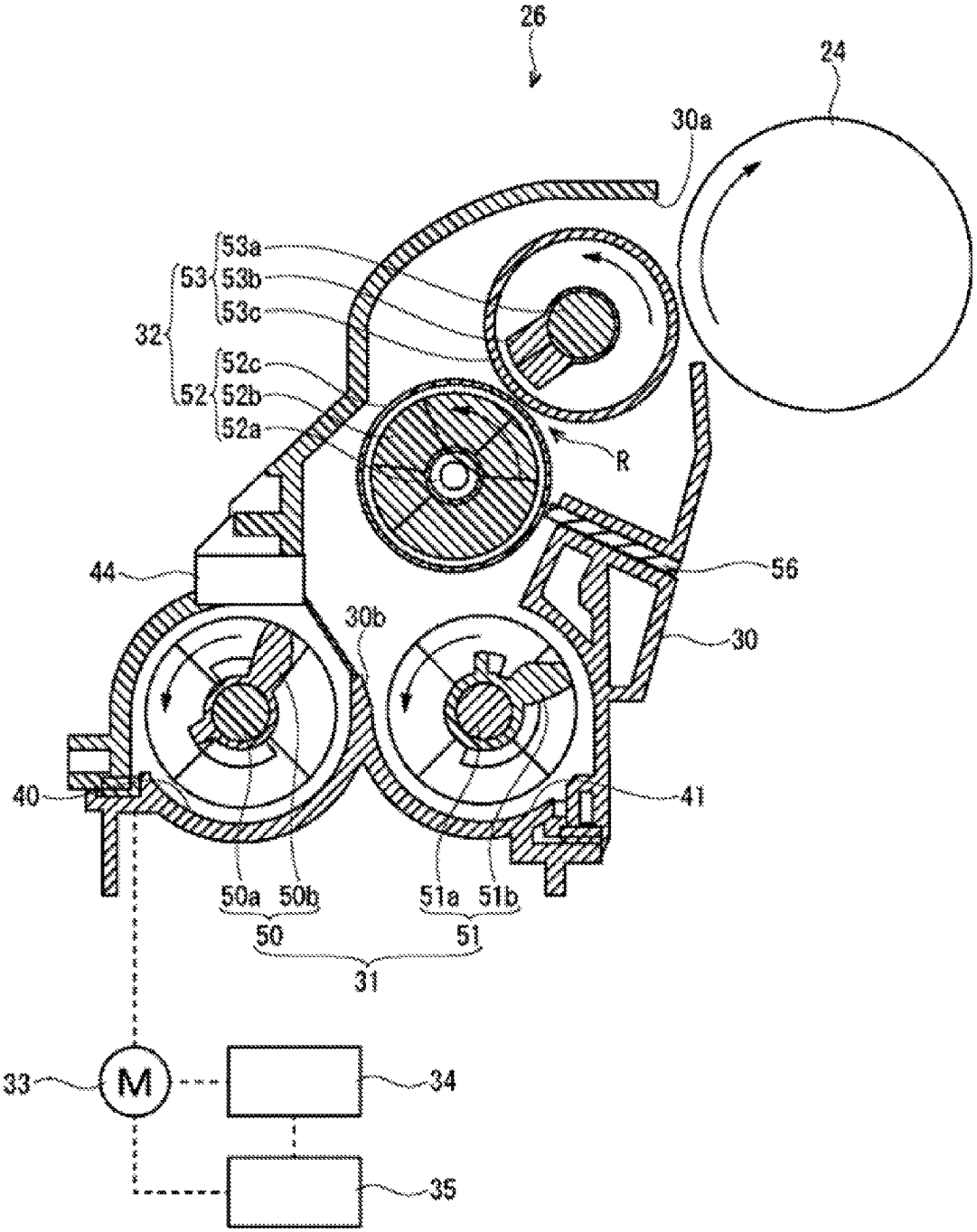
FIG. 2 is a sectional view illustrating an internal structure of a developing device according to a first embodiment.
Figure 3:
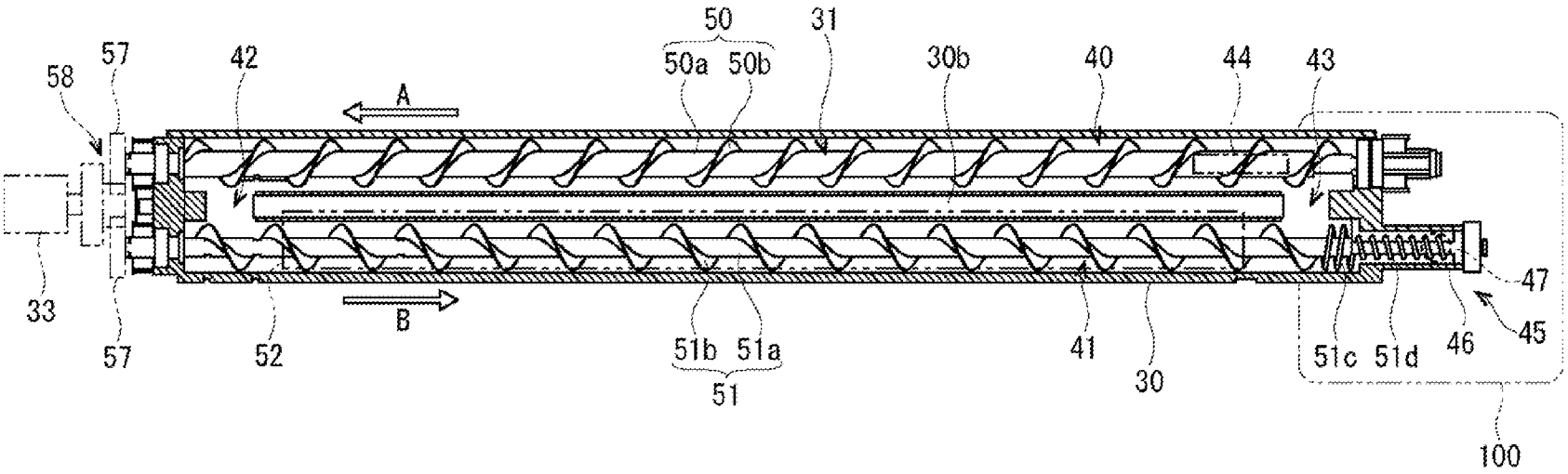
FIG. 3 is a sectional view of a first stirring member and a second stirring member of a developing device according to a first embodiment when viewed from a plane.
Figure 4:
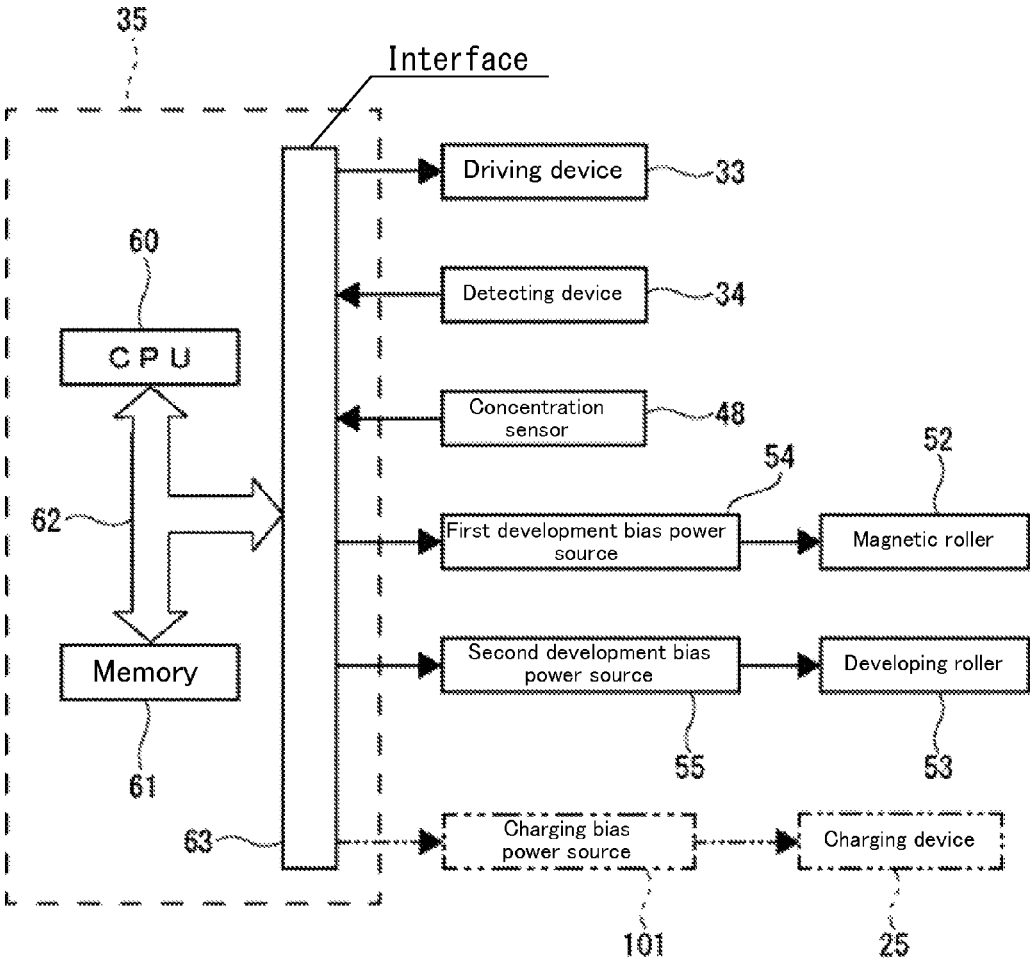
FIG. 4 is a block diagram illustrating a development control device and the like of a developing device according to a first embodiment.

Next, with reference to FIG. 2 to FIG. 4, the developing device 26 will be described. FIG. 2 is a sectional view illustrating an internal structure of the developing device 26. FIG. 3 is a sectional view of a first stirring member 30 and a second stirring member 31 when viewed from a plane. FIG. 4 is a block diagram illustrating a development control device 35 and the like. In addition, since the four developing devices 26 have a similar configuration, one developing device 26 will be illustrated in the description below.

As illustrated in FIG. 2, the developing device 26 includes a housing 30 that accommodates developer supplied from the toner container 20 and including toner and carrier therein, a stirring member 31 that rotates in the housing 30 to stir the developer in the housing 30, a developing unit body 32 that rotates in the housing 30 to convey the developer in the housing 30 toward the photosensitive drum 24 from the stirring member 31 and attaches the toner included in the developer to the photosensitive drum 24, a driving device 33 that rotationally drives the stirring member 31 and the developing unit body 32, a detecting device 34 that detects torque of the driving device 33, and a development control device 35 serving as a control device to control each element.

The housing 30, for example, is made of a resin material. The housing 30 is formed an upper right side thereof with an opening 30*a*. The housing 30 is provided at the lower portion of the inside thereof with a partition wall 30*b* vertically installed. The partition wall 30*b* extends in a longitudinal direction (see FIG. 3) so as to partition a first conveyance path 40 and a second conveyance path 41. The first conveyance path 40 and the second conveyance path 41 are provided in parallel to each other. In addition, in the following description, an upstream and a downstream are set on the basis of a conveyance direction (see a white arrow of FIG. 3) of developer conveyed through the second conveyance path 41.

As illustrated in FIG. 3, an upstream side communicating portion 42 is formed at an upstream end portion of the partition wall 30*b* to allow the first conveyance path 40 and the second conveyance path 41 to communicate with each other. Similarly, a downstream side communicating portion 43 is formed at a downstream end portion of the partition wall 30*b*.

The housing 30 is formed with a supply port 44 for supplying developer from the toner container 20 to the first conveyance path 40. The supply port 44 is provided in the vicinity of the downstream side communicating portion 43. The housing 30 is provided with a developer discharge portion 45 for discharging excess developer in an interior to an exterior of the housing 30. The developer discharge portion 45 has a discharge case 46 provided to allow the second conveyance path 41 to extend to the downstream side, and a discharge port 47 formed at a lower portion of the discharge case 46. A collection bottle 100 for storing the developer discharged to the exterior of the housing 30 is connected to the discharge port 47.

The housing 30 is provided with a concentration sensor 48 that detects an accommodation amount (concentration) of developer in each of the conveyance paths 40 and 41 (see FIG. 4). The concentration sensor 48, for example, detects permeability of developer.

As illustrated in FIG. 2 and FIG. 3, the stirring member 31 includes a first stirring member 50 disposed along the first conveyance path 40 and a second stirring member 51 disposed along the second conveyance path 41.

The first stirring member 50 and the second stirring member 51 are formed to respectively fix spiral screw blades 50*b* and 51*b* on the peripheral surfaces of rotating shafts 50*a* and 51*a*. Each stirring member 50 and 51 is supported to the housing 30 so as to be rotatable around the shafts thereof (a counterclockwise direction in FIG. 2). The screw blade 50*b* and the screw blade 51*b* are formed to have the same pitch and phases opposite to each other.

As illustrated in FIG. 3, the second stirring member 51 has a 2 to 3-winding reverse spiral blade 51*c* formed at a downstream side of the rotating shaft 51*a* and a spiral discharge blade 51*d* formed at a further downstream side from the reverse spiral blade 51*c*.

The reverse spiral blade 51*c* is formed with approximately the same outer diameter as that of the screw blade 51*b* and phases opposite to each other. The discharge blade 51*d* is disposed in the discharge case 46 and is formed to have a diameter smaller than that of the screw blade 51*b* and the same phase as that of the screw blade 51*b*.

As illustrated in FIG. 2, the developing unit body 32 has a magnetic roller 52 disposed above the second stirring member 51 so as to face to the second stirring member 51, and a developing roller 53 disposed at an obliquely upper right position of the magnetic roller 52 so as to face the magnetic roller 52.

The magnetic roller 52 has a roller shaft 52*a* supported to the housing 30 so as to be non-rotatable, a magnetic pole member 52*b* fixed to the roller shaft 52*a* and having a fan-shaped section, and a rotating sleeve 52*c* provided to cover the magnetic pole member 52*b*.

The rotating sleeve 52*c* is made of a non-magnetic material and has a cylindrical shape. The rotating sleeve 52*c* is supported to the housing 30 so as to be rotatable around the shaft (a counterclockwise direction in FIG. 2). The rotating sleeve 52*c* is electrically connected to a first development bias power source 54 (see FIG. 4). The first development bias power source 54 applies a first development bias obtained by superposing a DC voltage V10 and an AC voltage V11 to the magnetic roller 52.

The developing roller 53 has a fixed shaft 53*a* supported to the housing 30 so as to be non-rotatable, a development magnetic pole member 53*b* provided to face the magnetic pole member 52*b* of the magnetic roller 52, and a developing sleeve 53*c* provided to cover the development magnetic pole member 53*b*.

The development magnetic pole member 53*b* includes a magnet with a polarity different from that of the magnetic pole member 52*b*. The developing sleeve 53*c* is made of a non-magnetic material and has a cylindrical shape. The developing sleeve 53*c* has a space to the development magnetic pole member 53*b*, and is supported to the fixed shaft 53*a* so as to be rotatable around the fixed shaft 53*a* (a counterclockwise direction in FIG. 2).

The developing roller 53 is disposed to have a gap (hereinafter, referred to as an "opposite portion R") to the magnetic roller 52. The developing roller 53 is exposed from the opening 30*a* of the housing 30 and is disposed to face the photosensitive drum 24. The developing roller 53 is electrically connected to a second development bias power source 55 (see FIG. 4). The second development bias power source 55 applies a second development bias obtained by superposing a DC current V20 and an AC voltage V21 to the developing roller 53.

In the housing 30, a restraint blade 56 is downwardly inclined toward to the right side in FIG. 2. The restraint blade 56 is disposed at an upstream side of the opposite portion R in a rotation direction of the magnetic roller 52. The restraint blade 56 is disposed to have a gap to an outer peripheral surface of the magnetic roller 52.

The driving device 33 includes a so-called electric motor. As illustrated in FIG. 3, a gear 57 is mounted at one end portion of each of the rotating shaft 50*a*, the rotating shaft 51*a*, the rotating sleeve 52*c*, and the developing sleeve 53*c*. A plurality of the gears 57 constitute a gear train 58 by engaging with one another. The driving device 33 is connected to (engaged with) the gear train 58. When the driving device 33 is rotationally driven, each of the stirring members 50, 51, the magnetic roller 52, and the developing roller 53 rotate together with one another.

The detecting device 34 includes a current meter for measuring a value I of a current flowing through the driving device 33.

As illustrated in FIG. 4, the development control device 35 is configured to include a CPU (Central Processing Unit) 60, a memory 61, a bus 62, and an interface 63.

The CPU 60 performs arithmetic processing according to each program and the like. The memory 61 has a ROM (Read Only Memory), a RAM (Random Access Memory), a flash memory and the like. The memory 61 stores a program used in the arithmetic processing (development processing control) of the CPU 60, a rated value of each development bias, a supply time of developer, and the like. The memory 61 temporarily stores an arithmetic result and the like of the CPU 60. The bus 62 connects the CPU 60, the memory 61, and the interface 63 to one another. The driving device 33, the detecting device 34, the concentration sensor 48, the development power sources 54 and 55 and the like are electrically connected to the interface 63.

Next, with reference to FIG. 2 and FIG. 3, a development process of the developing device 26 will be described.

The development control device 35 controls the toner container 20 and supplies (refills) developer to the interior of the housing 30 (the first conveyance path 40) via the support port 44. The development control device 35 controls the driving device 33 to rotate the first stirring member 50, the second stirring member 51, the magnetic roller 52, and the developing roller 53. The development control device 35 controls the development power sources 54 and 55 to respectively apply the first development bias and the second development bias to the magnetic roller 52 and the developing roller 53.

The first stirring member 50 rotates around the shaft and stirs the developer in the first conveyance path 40 while conveying the developer in the direction of a white arrow A of FIG. 3. The conveyed developer enters into the second conveyance path 41 from the upstream side communicating portion 42. The second stirring member 51 rotates around the shaft and stirs the developer in the second conveyance path 41 while conveying the developer in the direction of a white arrow B of FIG. 3.

The reverse spiral blade 51*c* applies conveyance force to the developer in a direction opposite to that of the white arrow B. Therefore, most of the developer is blocked and enters into the first conveyance path 40 again from the downstream side communicating portion 43. That is, the developer circulates the first conveyance path 40 and the second conveyance path 41. In this way, the toner is charged at a predetermined level and is held in the carrier.

The magnetic roller 52 draws up and holds the charged developer. The developer forms a magnetic brush (not illustrated) on the magnetic roller 52. The restraint blade 56 restrains the thickness of the magnetic brush. The magnetic roller 52 conveys the magnetic brush to the opposite portion R opposing to the developing roller 53.

The toner included in the developer on the magnetic roller 52 is moved to the developing roller 53 by a potential difference ΔV between the DC voltage V10 applied to the magnetic roller 52 and the DC voltage V20 applied to the developing roller 53 and a magnetic field. That is, the developing roller 53 receives and carries the toner from the developer carried by the magnetic roller 52. In this way, a thin toner layer is formed on the developing roller 53.

The developing roller 53 conveys the thin toner layer to an area opposing to the photosensitive drum 24. By the potential difference between the developing roller 53 and the photosensitive drum 24, the toner on the developing roller 53 flies toward the photosensitive drum 24. In this way, an electrostatic latent image on the photosensitive drum 24 is developed into a toner image.

The developing roller 53 conveys toner remaining without being developed to the opposite portion R again. The magnetic brush on the magnetic roller 52 collects the toner conveyed to the opposite portion R. The magnetic brush is taken away from the magnetic roller 52 at the same pole portion of the magnetic pole member 52*b*, and falls into the second conveyance path 41.

Thereafter, on the basis of the detection result of the concentration sensor 48, the development control device 35 controls the toner container 20 and supplies developer to the interior of the housing 30. Furthermore, excess developer in the housing 30 climbs over the reverse spiral blade 51*c* and enters into the discharge case 46. The discharge blade 51*d* conveys the excess developer in the discharge case 46 to the discharge port 47. The excess developer is discharged to the collection bottle 100 from the discharge port 47. That is, the developing device 26 employs a trickle development system.

Figure 5:
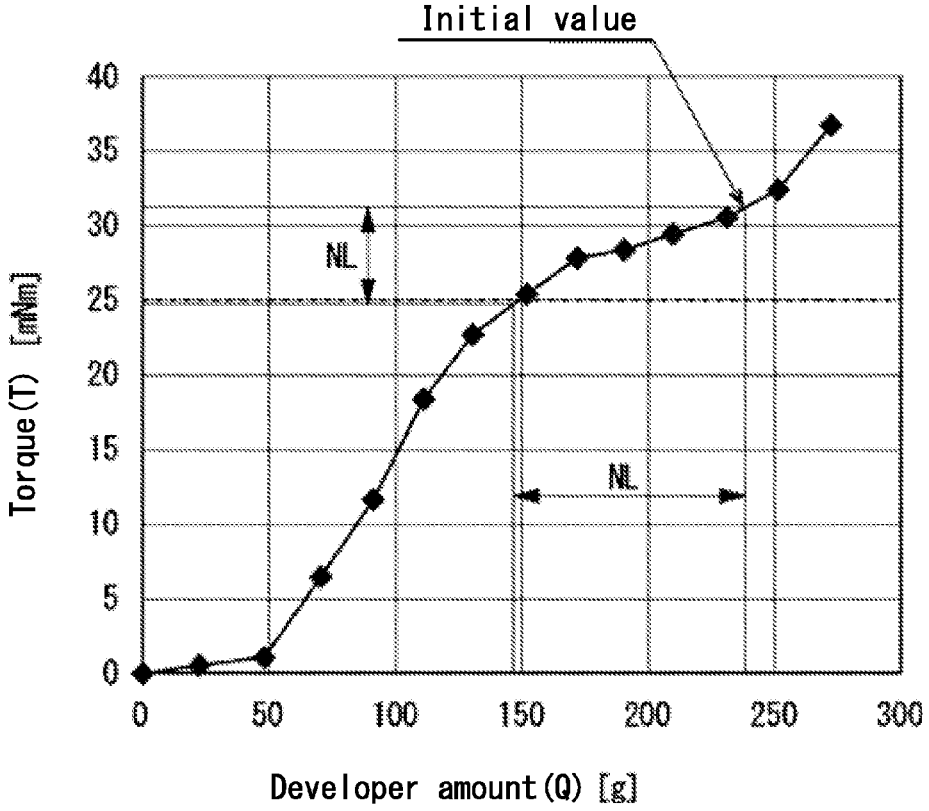
FIG. 5 is a graph (a Q-T curve) illustrating a relation between a developer amount and torque of a driving device in a developing device according to a first embodiment.

As illustrated in FIG. 5, a relation between the amount Q of the developer in the housing 30 and the torque T of the stirring member 31 (the driving device 33) is not linear, and is a unique curve (a Q-T curve). There are proper ranges NL for the amount of the developer and the torque of the driving device 33. The developing device 26 performs development processing while maintaining the developer amount Q in the vicinity of an upper limit value of the proper range NL. For example, the developing device 26 according to the first embodiment sets an initial value of the developer amount Q to 230 g and sets an initial value of the torque T to 31.0 mNm. In addition, each proper range NL, each initial value and the like have been stored in the memory 61 of the development control device 35.

However, for example, when a supply amount is larger than a developer discharge amount, the developer amount in the housing 30 is increased. An increase of the developer exceeding the upper limit value of the proper range NL increases a driving load of the stirring member 31 (50 and 51), resulting in the malfunction and the like of the developing device 26. In this case, for example, by stopping the supply of the developer, it is possible to reduce the amount of the developer in the housing 30.

On the other hand, for example, when the discharge port 47 of the housing 30 has been inclined downward, when the developer has been overflown from the housing 30, when a carrier adhesion phenomenon in which carrier is developed has occurred, and the like, the amount of the developer in the housing 30 is reduced. A reduction of the developer exceeding a lower limit value of the proper range NL causes deviation in the concentration of the toner carried by the developing roller 53 (attached to the photosensitive drum). Therefore, an excessive reduction of the developer causes image defects and the like.

In this regard, the developing device 26 according to the first embodiment is configured to appropriately recognize a reduction of the developer in the housing 30 and to be able to recover a developer amount.

The detecting device 34 detects (measures) a current value I corresponding to the torque T of the driving device 33. When the detection result of the detecting device 34 is lower than a threshold value TH, the development control device 35 performs a recovery process by controlling the toner container 20 to supply (refill) developer to the interior of the housing 30.

Figure 6:
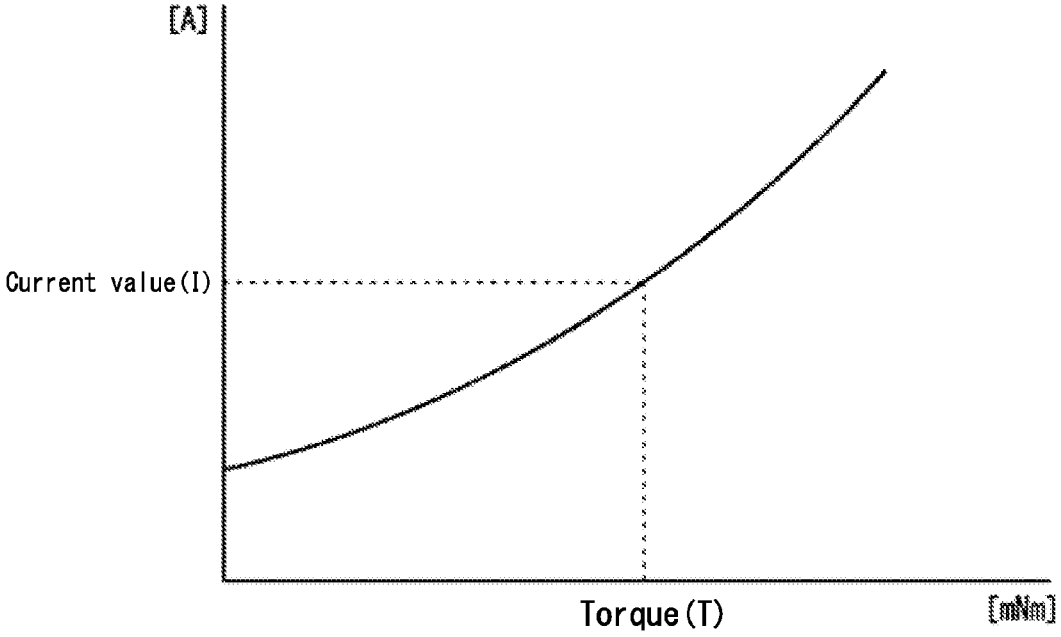
FIG. 6 is a graph (a T-I curve) illustrating a relation between torque of a driving device and a value of a current flowing through the driving device in a developing device according to a first embodiment.

As illustrated in FIG. 6, a relation between the current value I of the current flowing through the driving device 33 and the torque T is a unique curve (a T-I curve) for each driving device 33. The memory 61 of the development control device 35 stores a table corresponding to the T-I curve of the driving device 33. In this way, the development control device 35 can calculate the torque T from the current value I detected by the detecting device 34.

The threshold value TH as an execution reference of the recovery process, for example, is set by an experiment. Conditions (specifications) of the color printer 1 used in an experiment are as follows.

Print speed: 40 sheets/minute

Peripheral speed of photosensitive drum 24: 200 mm/sec

Developing roller 53: alumite surface treatment, resin coating

Peripheral speed of developing roller 53: peripheral speed ratio 1.5 with respect to photosensitive drum 24

Peripheral speed of magnetic roller 52: peripheral speed ratio 1.1 with respect to developing roller 53

Distance between photosensitive drum 24 and developing roller 53: 0.12 mm Distance between developing roller 53 and magnetic roller 52: 0.3 mm (Positive charge type toner (6.8 μm) was used)

In addition, setting of each potential is as illustrated in FIG. 7. FIG. 7 illustrates the case in which the photosensitive drum 24 is an organic photoconductor (OPC) (reversal development and normal development) and is amorphous silicon (α-Si) (reversal development).

The experimental result of the color printer 1 is as illustrated in FIG. 8. As illustrated in FIG. 8, the present applicant has confirmed that an image defect (image formation failure) occurs when the threshold value TH is lower than the initial value (31.0 mNm) of the torque T by 20% or more. Therefore, the threshold value TH has been stored in the memory 61 of the development control device 35 as a value (24.8 mm) lower than the initial value of the torque T of the driving device 33 by 20%.

Figure 9:
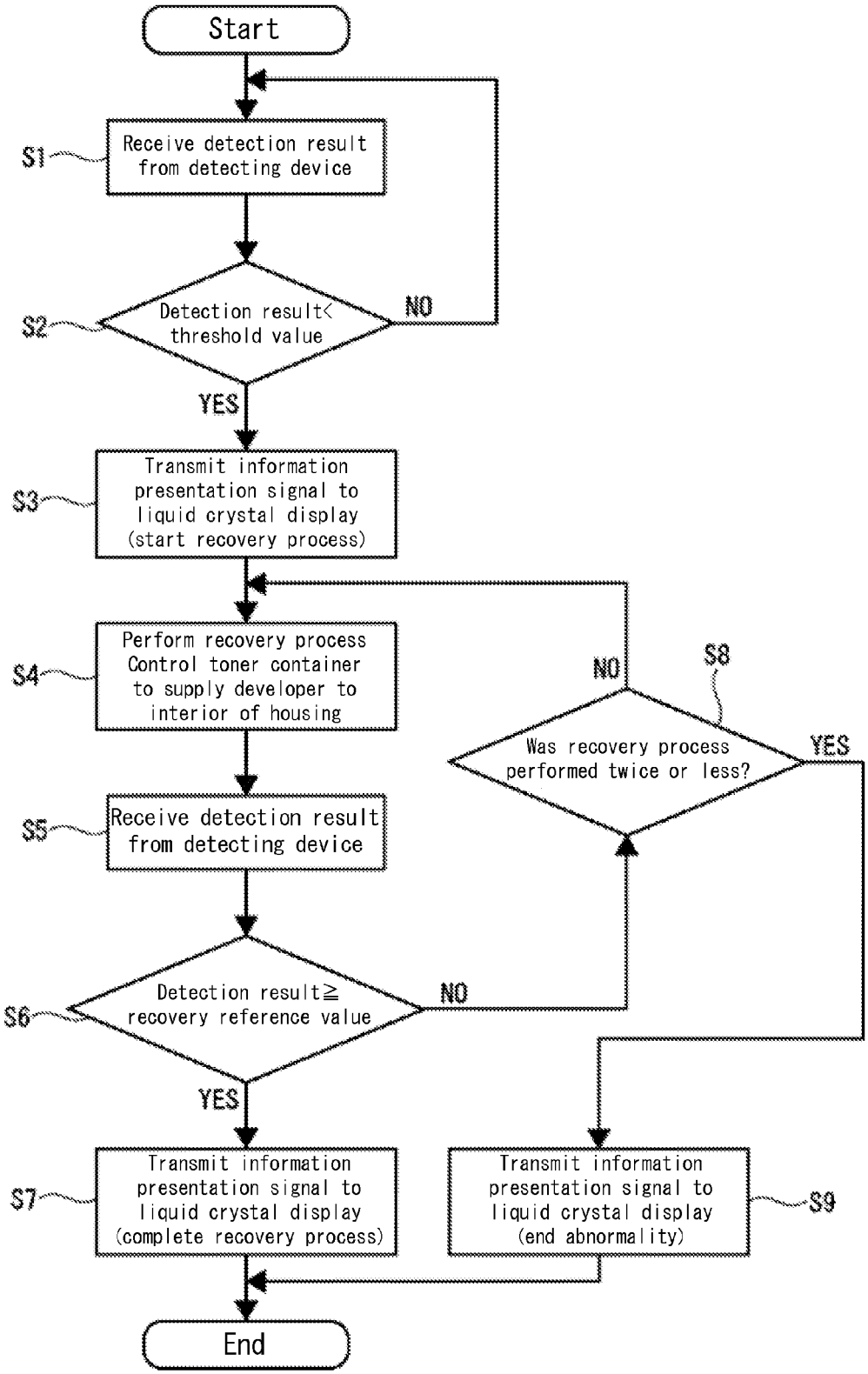
FIG. 9 is a flowchart illustrating a recovery mode performed by a development control device of a developing device according to a first embodiment.

With reference to FIG. 9, a recovery process performed by the development control device 35 of the developing device 26 according to the first embodiment will be described. FIG. 9 is a flowchart illustrating a recovery mode performed by the development control device 35.

The development control device 35 (the CPU 60) is configured to select a proper operation mode of a plurality of operation modes, such as an ordinary mode of performing an ordinary development process and a recovery mode of performing a recovery process, in response to the state of the developing device 26.

The development control device 35 receives information including the current value I transmitted from the detecting device 34 (step S1). The development control device 35 calculates the torque T of the driving device 33 from the current value I and employs the calculated result as a detection result of the detecting device 34. The development control device 35 compares the detection result with the threshold value TH stored in the memory 61 (step S2). When the detection result is equal to or more than the threshold value TH ("NO" in step S2), the development control device 35 performs the reception of the detection result again (step S1).

On the other hand, when the detection result is smaller than the threshold value TH ("YES" in step S2), the development control device 35 starts the recovery mode of performing the recovery process.

The development control device 35 outputs (transmits) an information presentation signal indicating the start of the recovery process to the liquid crystal display 5 (step S3). The liquid crystal display 5 displays the received information presentation signal (for example, character information and the like such as "during recovery process").

Next, as the recovery process, the development control device 35 controls the toner container 20 to supply developer to the interior of the housing 30 during the supply time (for example, five minutes) stored in the memory 61 (step S4). In addition, a relation between the supply time and the supply amount of the developer has been calculated in advance by an experiment and the like.

Next, similarly to step S1, the development control device 35 receives information including the current value I transmitted from the detecting device 34 (step S5). The development control device 35 employs the torque T of the driving device 33 calculated from the current value I as a detection result of the detecting device 34. The development control device 35 compares the detection result with a value (hereinafter, referred to as a "recovery reference value") corresponding to 90% of the initial value of the torque T stored in the memory 61 (step S6).

When the detection result is equal to or more than the recovery reference value ("YES" in step S6), the development control device 35 stops the recovery mode. The development control device 35 transmits an information presentation signal indicating the completion of the recovery process to the liquid crystal display 5 (step S7). The liquid crystal display 5 displays the received information presentation signal (for example, character information and the like such as "recovery process completion").

On the other hand, when the detection result is less than the recovery reference value ("NO" in step S6), the development control device 35 determines whether the number of executions of the recovery processes is less than 2 (step S8). In addition, the memory 61 of the development control device 35 has a counter (or a flag) for storing and holding the number of the recovery processes. When the number of executions of the recovery processes is less than 2 ("NO" in step S8), the development control device 35 controls the toner container 20 to supply developer to the interior of the housing 30 again (step S4).

On the other hand, when the number of executions of the recovery processes is equal to or more than 2 ("YES" in step S8), the development control device 35 transmits an information presentation signal indicating that the recovery process has not been normally completed to the liquid crystal display 5 (step S9). The liquid crystal display 5 displays the received information presentation signal (for example, character information and the like such as "abnormal end"). Then, the development control device 35 stops the recovery mode.

In accordance with the developing device 26 according to the first embodiment as described above, the detecting device 34 detects a reduction of the developer in the housing 30 as a reduction of the torque T (exactly, the current value I corresponding to the torque T) of the driving device 33. Therefore, the detecting device 34 can appropriately detect the reduction of the developer regardless of a factor (for example, the inclination of the housing 30, overflowing of the developer from the housing 30, a carrier adhesion phenomenon and the like) of the reduction of the developer. The development control device 35 recognizes the reduction of the developer in the housing 30 on the basis of the detection result of the detecting device 34, and performs the recovery process. As the recovery process, the development control device 35 supplies developer to the interior of the housing 30, thereby increasing the amount of carrier in the housing 30. In this way, the torque T of the driving device 33 can be recovered toward an initial value. That is, a developer amount in the housing 30 is recovered and deviation of toner concentration for attachment to the photosensitive drum 24 is prevented. As a consequence, it is possible to ensure good image formation.

Furthermore, in accordance with the developing device 26 according to the first embodiment, the threshold value TH is set to a value lower than the initial value of the torque T of the driving device 33 by 20%. Therefore, before image detects occur, it is possible to recover the developer amount in the housing 30. In addition, as illustrated in FIG. 8, the present applicant has confirmed that it is possible to maintain good image formation by performing the recovery process when the threshold value TH has been lower than the initial value by 20% or more, through an experiment and the like.

In addition, the threshold value TH is not limited to the value lower than the initial value of the torque T by 20%. It is sufficient if the threshold value TH is set to be within a range more than or equal to a value of the torque T of the driving device 33 lower than the initial value by 20% and less than the initial value.

Furthermore, in accordance with the developing device 26 according to the first embodiment, when the detection result of the detecting device 34 has been recovered to 90% or more of the initial value of the torque T of the driving device 33 as a result of the recovery process, the development control device 35 stops the operation mode (the recovery mode) of performing the recovery process. Therefore, the development control device 35 can complete the recovery process in a short time as compared with the case in which the torque T of the driving device 33 is recovered to the initial value. In this way, for example, it is possible to shorten a time for suspending an image forming process, thereby improving usability.

Furthermore, in accordance with the developing device 26 according to the first embodiment, in the case of performing the recovery process, the development control device 35 outputs (transmits) the information presentation signal regarding the recovery process toward the liquid crystal display 5. In this way, a user can definitely recognize information on the recovery process. That is, it is possible to achieve the improvement of usability.

In addition, the development control device 35 of the developing device 26 according to the first embodiment supplies developer to the interior of the housing 30 as the recovery process (step S4); however, the technology of the present disclosure is not limited thereto. It is sufficient if the development control device 35 supplies at least one of carrier and developer to the interior of the housing 30 as the recovery process (step S4). That is, it is sufficient if the amount of carrier in the housing 30 is increased by performing the recovery process (step S4). For example, the toner container 20 may be configured to be able to separately supply developer and carrier. Furthermore, for example, in addition to the toner container 20, a carrier container (not illustrated) for supplying only carrier may be separately provided. In this case, the development control device 35 may control the toner container 20 or the carrier container to supply only the carrier to the interior of the housing 30. In addition, the development control device 35 may control the toner container 20 and the carrier container to supply developer and carrier to the interior of the housing 30.

In addition, the information presentation signal transmitted to the liquid crystal display 5 by the development control device 35 is not limited to character information. The information presentation signal, for example, may include image information, or sound information which is outputted from a speaker (not illustrated) and the like as a presentation device.

Second Embodiment

Figure 10:
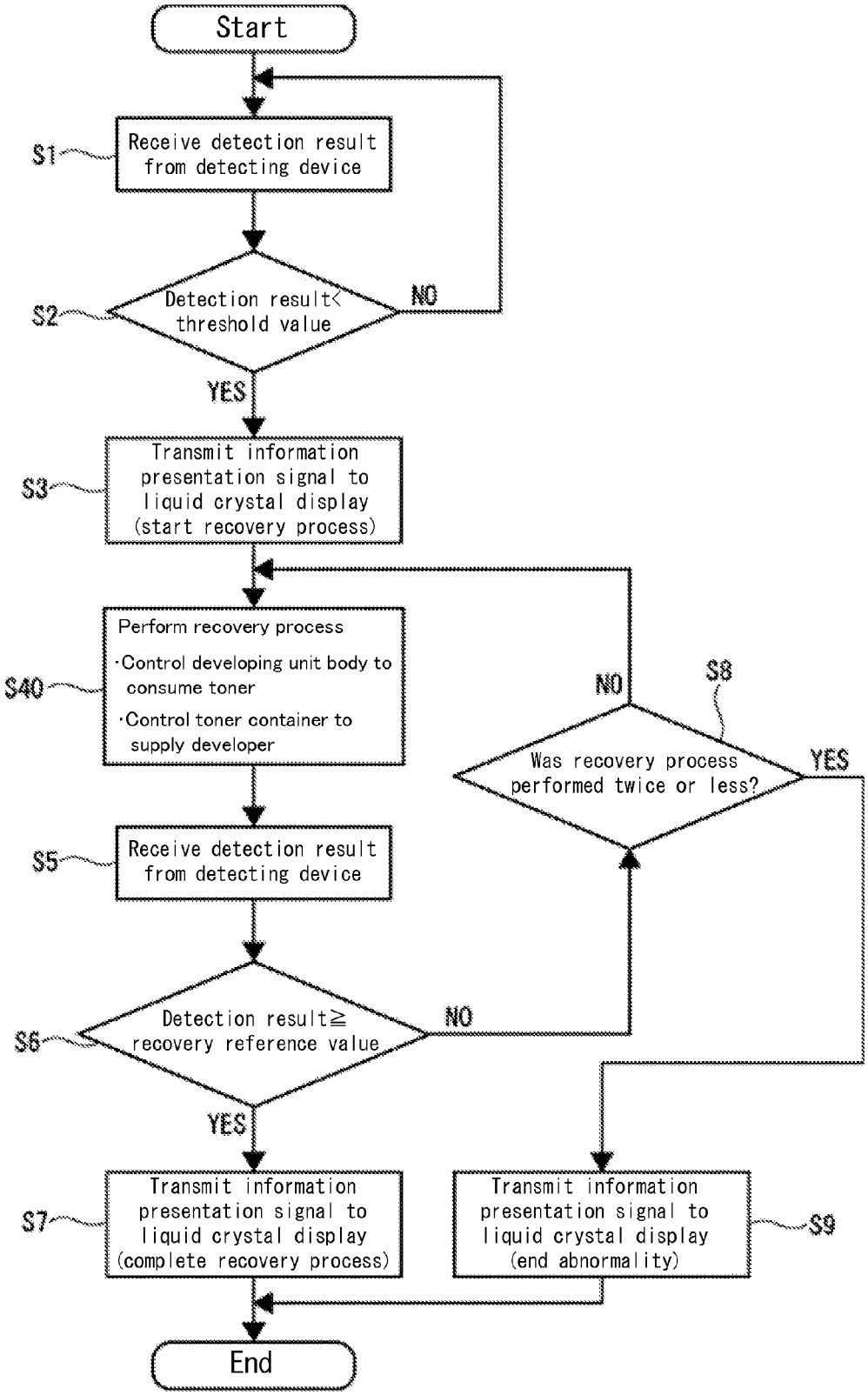
FIG. 10 is a flowchart illustrating a recovery mode performed by a development control device of a developing device according to a second embodiment.

Next, with reference to FIG. 10, a recovery process performed by the development control device 35 of the developing device 26 according to the second embodiment will be described. FIG. 10 is a flowchart illustrating a recovery mode performed by the development control device 35. Hereinafter, the same reference numerals are used to designate the same elements as those of the developing device 26 according to the aforementioned first embodiment, and a description thereof will be omitted.

When the detection result of the detecting device 34 is lower than the threshold value TH, the development control device 35 controls the developing unit body 32 to consume toner and performs a recovery process of controlling the toner container 20 to supply developer to the interior of the housing 30.

In detail, after performing step S3, the development control device 35 controls the magnetic roller 52 and the developing roller 53 to perform the aforementioned development process, thereby consuming toner (step S40). In addition, the consumption of the toner, for example, is realized by developing a test image and the like stored in the main control device 16 in advance. Furthermore, simultaneously with the consumption of the toner, the development control device 35 controls the toner container 20 to supply developer to the interior of the housing 30 (step S40). In addition, since step S1 to S3 and step S5 to S9 are similar to the recovery process according to the first embodiment, a description thereof will be omitted.

In accordance with the developing device 26 according to the second embodiment as described above, regardless of a factor of a reduction of developer in the housing 30, the detecting device 34 detects the reduction of the developer as a reduction of the torque of the driving device 33. As the recovery process (step S40), the development control device 35 reduces toner existing in the housing 30 and supplies new developer to the interior of the housing 30. In this way, since the amount of carrier in the housing 30 is increased, it is possible to recover the torque T of the driving device 33 toward the initial value. As a consequence, it is possible to ensure good image formation.

In addition, when only carrier is supplied to the interior of the housing 30 from the carrier container in step S4 of the recovery process according to the first embodiment, the development control device 35 may simultaneously perform step S4 and step S40, or may perform step S40 after (or before) performing step S4.

Third Embodiment

Figure 11:
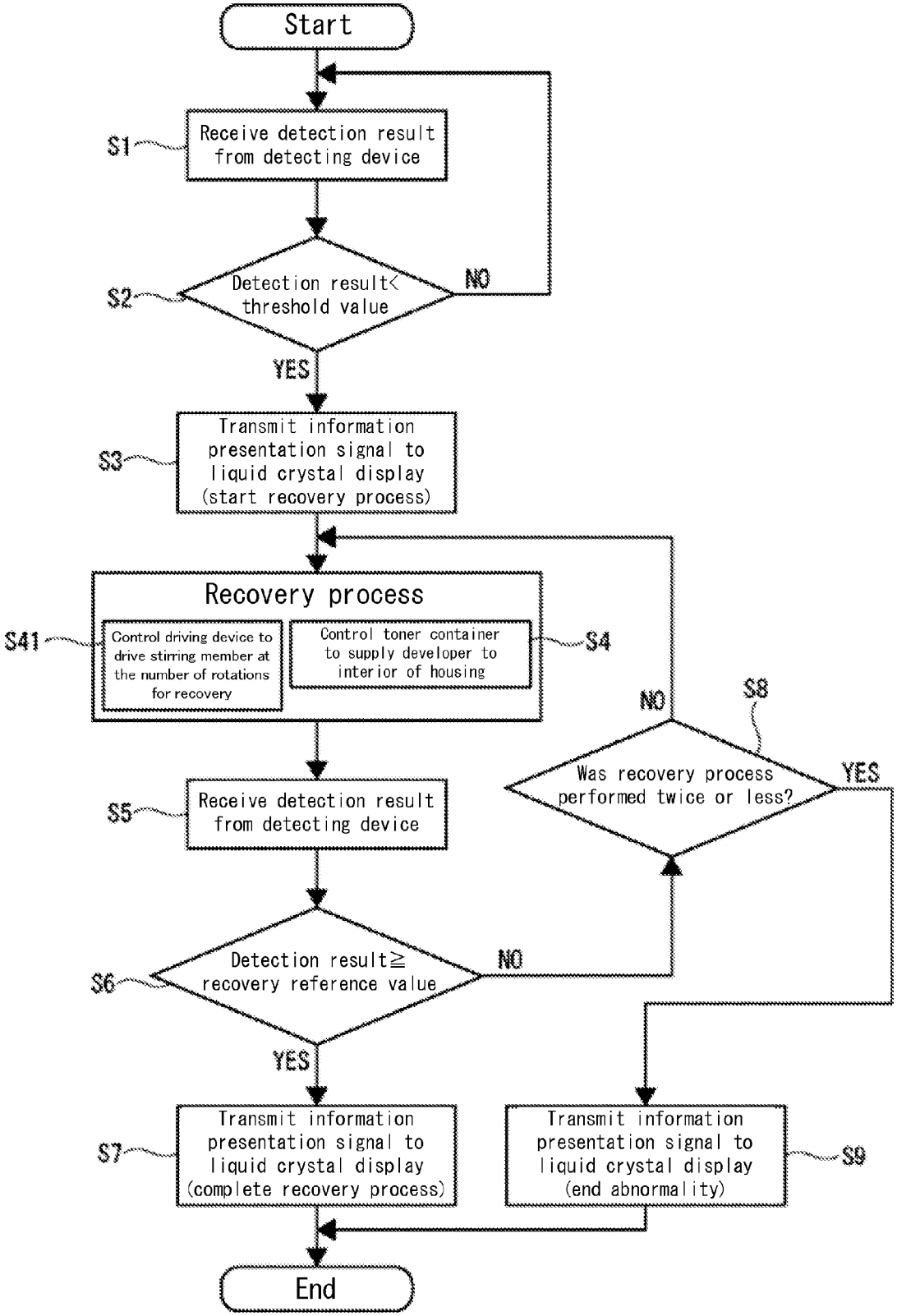
FIG. 11 is a flowchart illustrating a recovery mode performed by a development control device of a developing device according to a third embodiment.

Next, with reference to FIG. 11, a recovery process performed by the development control device 35 of the developing device 26 according to the third embodiment will be described. FIG. 11 is a flowchart illustrating a recovery mode performed by the development control device 35. Hereinafter, the same reference numerals are used to designate the same elements as those of the developing device 26 according to the aforementioned first embodiment, and a description thereof will be omitted.

As a recovery process, the development control device 35 controls the driving device 33 to more reduce the number of rotations of the stirring member 31 than a reference number of rotations, thereby reducing developer which is discharged from the developer discharge portion 45 (the discharge port 47).

In detail, after performing step S3, the development control device 35 controls the driving device 33 to rotationally drive the stirring member 31 (the first stirring member 50 and the second stirring member 51) at the number of rotations for recovery corresponding to about a half of the reference number of rotations (step S41). The development control device 35 simultaneously performs step S41 and step S4 of supplying developer to the interior of the housing 30. In addition, since step S1 to S3 and step S5 to S9 are similar to the recovery process according to the first embodiment, a description thereof will be omitted.

In addition, the reference number of rotations, for example, is the number of rotations of the stirring member 31 used in the case of performing an ordinary image forming process on a plain sheet. The number of rotations for recovery, for example, is the number of rotations of the stirring member 31 used in a half-speed mode, in which the photosensitive drum 24 and the like are rotated at a low speed, in the case of performing an image forming process on a thick sheet and the like thicker than a plain sheet. In addition, information for rotating the stirring member 31 at the reference number of rotations or the number of rotations for recovery has been stored in the memory 61 of the development control device 35. In addition, the number of rotations for recovery may be arbitrarily set if the number of rotations for recovery is lower (a lower speed) than the reference number of rotations.

In accordance with the developing device 26 according to the third embodiment as described above, as the recovery process (step S41), the development control device 35 reduces the number of rotations of each of the first stirring member 50 and the second stirring member 51. Therefore, a conveyance speed of developer circulating the conveyance paths 40 and 41 is reduced. Furthermore, the discharge amount of developer from the developer discharge portion 45 (the discharge port 47) is also reduced (decreased). In this way, the amount of carrier in the housing 30 is relatively increased, so that the torque T of the driving device 33 can be recovered to an initial value. As a consequence, it is possible to ensure good image formation.

In addition, the development control device 35 of the developing device 26 according to the third embodiment simultaneously performs step S41 and step S4; however, the technology of the present disclosure is not limited thereto. For example, instead of step S4, the development control device 35 may simultaneously perform step S40 according to the second embodiment and step S41. Furthermore, for example, the development control device 35 may also perform step S41 after (or before) performing step S4 and step S40.

Fourth Embodiment

Figure 12:
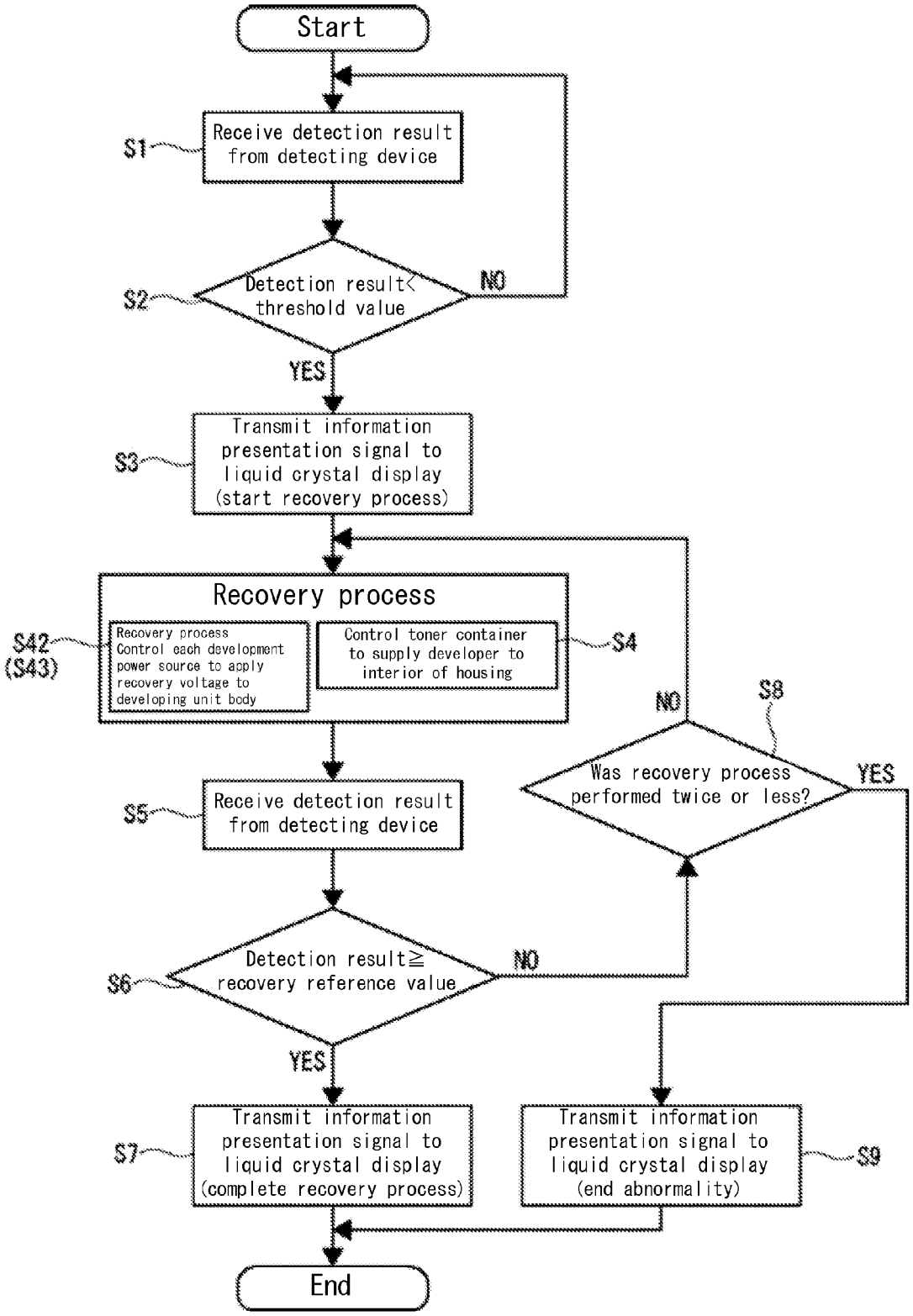
FIG. 12 is a flowchart illustrating a recovery mode performed by a development control device of a developing device according to a fourth embodiment and a modification thereof.

Next, with reference to FIG. 7 and FIG. 12, a recovery process performed by the development control device 35 of the developing device 26 according to the fourth embodiment will be described. FIG. 12 is a flowchart illustrating a recovery mode performed by the development control device 35. Hereinafter, the same reference numerals are used to designate the same elements as those of the developing device 26 according to the aforementioned first embodiment, and a description thereof will be omitted.

Each of the development power sources 54 and 55 applies each development bias to the developing unit body 32 such that reversal development is performed. As a recovery process, the development control device 35 controls the second development bias power source 55 to more reduce the potential difference ΔV1 between the potential VL of the exposure portion of the photosensitive drum 24 and the DC voltage of the second development bias than the reference potential difference ΔV0.

In detail, as illustrated in FIG. 12, after performing step S3, the development control device 35 controls the first development bias power source 54 to apply a recovery voltage V12 lower than the DC voltage V10 in the case of performing an ordinary development process to the magnetic roller 52 (step S42). Furthermore, the development control device 35 controls the second development bias power source 55 to apply a recovery voltage V22 lower than the DC voltage V20 in the case of performing the ordinary development process to the developing roller 53 (step S42). The development control device 35 simultaneously performs step S42 and step S4. In addition, a potential difference between the recovery voltages V12 and V22 is equal to the potential difference ΔV between the DC voltages V10 and V20.

As illustrated in (see columns of the reversal development (OPC)) of FIG. 7, when the ordinary image forming process has been performed using the photosensitive drum 24 including OPC, the reference potential difference ΔV0 between the potential (VL=+100 V) of the exposure portion of the photosensitive drum 24 and the DC voltage (V20=+190 V) applied to the developing roller 53 is 90 V. In contrast, when the recovery process (step S42) has been performed, the potential difference ΔV1 between the potential (VL=+100 V) of the exposure portion and the recovery voltage (V22=+155 V) for recovery applied to the developing roller 53 is 55 V.

As illustrated in (see columns of the reversal development (α-Si)) of FIG. 7, when the ordinary image forming process has been performed using the photosensitive drum 24 including α-Si, the reference potential difference ΔV0 between the potential (VL=+20 V) of the exposure portion and the DC voltage (V20=+50 V) is 30 V. In contrast, when the recovery process (step S42) has been performed, the potential difference ΔV1 between the potential (VL=+20 V) of the exposure portion and the recovery voltage (V22=+30 V) for recovery is 10 V.

In accordance with the developing device 26 employing the reversal development system according to the fourth embodiment as described above, as the recovery process (step S42), the development control device 35 reduces the potential difference between the potential of the exposure portion of the photosensitive drum 24 and the DC voltage of the second development bias. In detail, the development control device 35 controls the second development bias power source 55 such that the potential difference ΔV1 has a value corresponding to ⅔ or less of the reference potential difference ΔV0. By such control, so that the amount of carrier (the consumption amount of carrier) moving from the developing unit body 32 (the developing roller 53) toward the photosensitive drum 24 is suppressed. In this way, the amount of carrier in the housing 30 is increased, so that the torque of the driving device 33 can be recovered to an initial value. As a consequence, it is possible to ensure good image formation.

Modification of Fourth Embodiment

In addition, the recovery process performed by the development control device 35 of the developing device 26 according to the fourth embodiment may be applied to a developing device 26 employing a normal development system.

Each of the development power sources 54 and 55 applies each development bias to the developing unit body 32 such that normal development is performed. As a recovery process, the development control device 35 controls the second development bias power source 55 to more reduce the potential difference ΔV1 between a potential Vo of a non-exposure portion of the photosensitive drum 24 and the DC voltage of the second development bias than the reference potential difference ΔV0.

Similarly to step S42 according to the aforementioned fourth embodiment, the development control device 35 controls the development power sources 54 and 55 to respectively apply the recovery voltages V12 and V22 lower than the DC voltages V10 and V20 in the case of performing the ordinary development process to the magnetic roller 52 and the developing roller 53 (step S43 (see FIG. 12)). The development control device 35 simultaneously performs step S43 and step S4. In addition, the potential difference between the recovery voltages V12 and V22 is equal to the potential difference ΔV between the DC voltages V10 and V20.

As illustrated in (see columns of the reversal development (OPC)) of FIG. 7, when the ordinary image forming process has been performed using the photosensitive drum 24 including OPC, the reference potential difference ΔV0 between the potential (Vo=−460 V) of the non-exposure portion of the photosensitive drum 24 and the DC voltage (V20=−360 V) applied to the developing roller 53 is 100 V. In contrast, when the recovery process (step S43) has been performed, the potential difference ΔV1 between the potential (Vo=−460 V) of the non-exposure portion and the recovery voltage (V22=−410 V) applied to the developing roller 53 is 50 V.

In accordance with the developing device 26 employing the normal development system according to the modification of the fourth embodiment as described above, it is possible to achieve the same effects as those of the developing device 26 employing the reversal development system according to the aforementioned fourth embodiment.

In addition, the development control device 35 of the developing device 26 according to the fourth embodiment (including the modification) controls the first development bias power source 54 and the second development bias power source 55. Instead, the development control device 35 may control a charging bias power source 101 (see FIG. 4) for charging the photosensitive drum 24. The charging bias power source 101 applies a charging bias to the charging device 25 to charge the photosensitive drum 24.

In addition, the development control device 35 of the developing device 26 according to the fourth embodiment (including the modification) simultaneously performs step S42 (S43) and step S4; however, the technology of the present disclosure is not limited thereto. For example, instead of step S4, the development control device 35 may simultaneously perform at least one of step S40 according to the second embodiment and step S41 according to the third embodiment and step S42 (S43). Furthermore, for example, the development control device 35 may perform step S42 (S43) after (or before) performing step S4, step S40, and step S41.

In addition, the driving device 33 of the developing device 26 according to the aforementioned each embodiment rotates the first stirring member 50, the second stirring member 51, the magnetic roller 52, and the developing roller 53 together with one another; however, the technology of the present disclosure is not limited thereto. It is sufficient if the driving device 33 has a configuration of rotationally driving at least one of the first stirring member 50, the second stirring member 51, the magnetic roller 52, and the developing roller 53 (the developing unit body 32). Furthermore, the driving device 33 may rotationally drive another member other than the developing device 26. In this case, it is preferable that no load change occurs when the other member is rotationally driven.

In addition, the development control device 35 of the developing device 26 according to the aforementioned each embodiment performs the recovery process twice; however, the number of executions of the recovery processes is arbitrary.

In addition, the main control device 16 may have the functions of the development control device 35. In this case, the main control device 16 controls the developing device 26.

In addition, in the description of the aforementioned each embodiment, since preferred embodiments in the developing device 26 and the color printer 1 including the same of the present disclosure have been described, there is a case in which technically preferable various limitations are added to the embodiments. However, the technical scope of the present disclosure is not limited to these embodiments unless otherwise specifically limited. Moreover, the elements in the aforementioned each embodiment can be appropriately replaced with existing elements and the like, various variations including a combination with other existing elements are possible, and the description of the aforementioned each embodiment is not intended to limit the contents described in the appended claims.

What is claimed is:

1. A developing device comprising:

a housing that accommodates developer supplied from a supply means and including toner and carrier therein;

a stirring member that rotates in the housing to stir the developer in the housing;

a developing unit body that rotates in the housing to convey the developer in the housing toward an image carrying member from the stirring member and attaches the toner included in the developer to the image carrying member;

a driving device that rotationally drives at least one of the stirring member and the developing unit body;

a detecting device that detects torque of the driving device;

a development bias power source that applies a development bias obtained by superposing a DC voltage and an AC voltage to the developing unit body such that reversal development is performed; and a control device, wherein the developing unit body comprises:

a magnetic roller disposed to face the stirring member and carry the developer; and a developing roller disposed to face the magnetic roller, receive the toner from the developer carried by the magnetic roller, and carry the toner, and wherein the control device performs a recovery process of controlling the supply means to supply at least one of the carrier and the developer to an interior of the housing when a detection result of the detecting device has a value lower than a threshold value, and controlling the development bias power source or a charging bias power source for charging the image carrying member, thereby reducing a potential difference between a potential of an exposure portion of the image carrying member and a DC voltage of the development bias to below a reference potential difference.

2. The developing device of claim 1, further comprising:

a developer discharge portion that discharges excess developer in an interior to an exterior of the housing, wherein, as the recovery process, the control device also controls the driving device to reduce a number of rotations of the stirring member to less than a reference number of rotations, thereby reducing the developer which is discharged from the developer discharge portion.

3. The developing device of claim 1, wherein the threshold value is set to be within a range more than or equal to a value lower than an initial value of the torque of the driving device by 20% and less than the initial value.

4. The developing device of claim 1, wherein, when the detection result of the detecting device is recovered to 90% or more of an initial value of the torque of the driving device by performing the recovery process, the control device stops an operation mode of performing the recovery process.

5. The developing device of claim 1, wherein, when the recovery process is performed, the control device outputs an information presentation signal regarding the recovery process toward a presentation device that presents information toward a user.

6. An image forming apparatus including the developing device of claim 1.

7. A developing device comprising:

a housing that accommodates developer supplied from a supply means and including toner and carrier therein;

a stirring member that rotates in the housing to stir the developer in the housing;

a developing unit body that rotates in the housing to convey the developer in the housing toward an image carrying member from the stirring member and attaches the toner included in the developer to the image carrying member;

a driving device that rotationally drives at least one of the stirring member and the developing unit body;

a detecting device that detects torque of the driving device;

a development bias power source that applies development bias obtained by superposing a DC voltage and an AC voltage to the developing unit body such that normal development is performed; and a control device, wherein the developing unit body comprises:

a magnetic roller disposed to face the stirring member and carry the developer; and a developing roller disposed to face the magnetic roller, receive the toner from the developer carried by the magnetic roller, and carry the toner, and wherein the control device performs a recovery process of controlling the supply means to supply at least one of the carrier and the developer to an interior of the housing when a detection result of the detecting device has a value lower than a threshold value, and controlling the development bias power source or a charging bias power source for charging the image carrying member, thereby reducing a potential difference between a potential of a non-exposure portion of the image carrying member and a DC voltage of the development bias to below a reference potential difference.

8. The developing device of claim 7, further comprising:

a developer discharge portion that discharges excess developer in an interior to an exterior of the housing, wherein, as the recovery process, the control device also controls the driving device to reduce a number of rotations of the stirring member to less than a reference number of rotations, thereby reducing the developer which is discharged from the developer discharge portion.

9. The developing device of claim 7, wherein the threshold value is set to be within a range more than or equal to a value lower than an initial value of the torque of the driving device by 20% and less than the initial value.

10. The developing device of claim 7, wherein, when the detection result of the detecting device is recovered to 90% or more of an initial value of the torque of the driving device by performing the recovery process, the control device stops an operation mode of performing the recovery process.

11. The developing device of claim 7, wherein, when the recovery process is performed, the control device outputs an information presentation signal regarding the recovery process toward a presentation device that presents information toward a user.

* * * * *